US009909787B2

(12) United States Patent
Spooner et al.

(10) Patent No.: US 9,909,787 B2
(45) Date of Patent: Mar. 6, 2018

(54) PULSE TUBE REFRIGERATOR/CRYOCOOLER APPARATUS

(71) Applicant: The Hymatic Engineering Company Limited, Bracknell, Berkshire (GB)

(72) Inventors: Scott Spooner, Bromsgrove (GB); Chun Fai Cheuk, Redditch (GB)

(73) Assignee: THE HYMATIC ENGINEERING COMPANY LIMITED, Berkshire (GB)

( * ) Notice: Subject to any disclaimer, the term of this patent is extended or adjusted under 35 U.S.C. 154(b) by 844 days.

(21) Appl. No.: 14/182,037

(22) Filed: Feb. 17, 2014

(65) Prior Publication Data

US 2014/0230457 A1 Aug. 21, 2014

(30) Foreign Application Priority Data

Feb. 19, 2013 (GB) ..... 1302888.1

(51) Int. Cl.
*F25B 9/00* (2006.01)
*F25B 9/14* (2006.01)

(52) U.S. Cl.
CPC ..... *F25B 9/145* (2013.01); *F25B 2309/1406* (2013.01); *F25B 2309/1415* (2013.01); *F25B 2309/1423* (2013.01)

(58) Field of Classification Search
CPC ..... F25B 9/145; F25B 2309/1406; F25B 2309/1423; F25B 2309/1415; F25B 2309/1407; F25B 2309/1408; F25B 2309/1409
USPC ..... 62/6
See application file for complete search history.

(56) References Cited

U.S. PATENT DOCUMENTS 6,196,006 B1 * 3/2001 Kawano ..... F25B 9/145 60/520
2007/0157632 A1 7/2007 Saito
2009/0151364 A1 * 6/2009 Dicken ..... F25B 9/145 62/6

(Continued)

FOREIGN PATENT DOCUMENTS

CN 101852506 A 10/2010
CN 102393096 A 10/2010
EP 0803687 A1 * 10/1997 ..... F25B 9/14

(Continued)

OTHER PUBLICATIONS

UK Search Report of GB1302888.1 dated Oct. 25, 2013.
Search Report from EP application No. GB1504768.1, dated Jul. 30, 2015.

*Primary Examiner* — Frantz Jules
*Assistant Examiner* — Steve Tanenbaum
(74) *Attorney, Agent, or Firm* — Shimokaji IP

(57) ABSTRACT

A pulse tube refrigerator/cryocooler apparatus including: an inlet for receiving a cyclically moving volume of gas; a regenerator device fluidly connected to the inlet for storing and recovering thermal energy from the gas; a pulse tube fluidly connected to the regenerator; and a conduit fluidly connected at one end to the pulse tube and fluidly connected at its opposite end to a container, said container providing a storage volume for gas, wherein apparatus is configured such that the cyclically moving gas enters the regenerator in a direction parallel to its elongate axis.

20 Claims, 10 Drawing Sheets

(56) References Cited

U.S. PATENT DOCUMENTS

2012/0193216 A1* 8/2012 Endo ..... C23C 14/50
204/192.1

FOREIGN PATENT DOCUMENTS

JP 2003166766 A 6/2003
WO 2013/044604 A1 4/2013

* cited by examiner

PULSE TUBE REFRIGERATOR/CRYOCOOLER APPARATUS

BACKGROUND OF THE INVENTION

This invention relates to a pulse tube refrigerator/cryocooler apparatus and to a gas flow distribution device for use therewith.

The general function of a pulse tube cryocooler apparatus is well known to one skilled in the art, and generally includes the following features/components:

a) a piston for effecting cyclical movement of gas (e.g. Helium);
b) a regenerator for storing and recovering thermal energy of the gas moving cyclically in that direction as a result of the piston;
c) a pulse tube fluidly connected to the regenerator, acting as an insulator between the regenerator and the remainder of the cryocooler;
d) an inertance tube offering restriction and inertial effect to the cyclically moving gas, fluidly connected to the pulse tube; and
e) a container (often referred to as a "reservoir") fluidly connected to the inertance tube, for storing a volume of gas.

The function of the cryocooler is to provide cooling to a device, particularly cryogenic temperatures. The present invention has been devised to achieve temperatures lower than 80K.

According to a first aspect of the present invention, we provide a pulse tube refrigerator/cryocooler apparatus including:

a) an inlet for receiving a cyclically moving volume of gas;
b) a regenerator device fluidly connected to the inlet for storing and recovering thermal energy from the gas;
c) a pulse tube fluidly connected to the regenerator; and
d) a conduit fluidly connected at one end to the pulse tube and fluidly connected at its opposite end to a container, said container providing a storage volume for gas,
e) wherein apparatus is configured such that the cyclically moving gas enters the regenerator in a direction parallel to its elongate axis.

According to a second aspect of the present invention, we provide a pulse tube refrigerator/cryocooler apparatus including:

a) an inlet for receiving a cyclically moving volume of gas;
b) a regenerator device fluidly connected to the inlet for storing and recovering thermal energy from the gas;
c) a pulse tube fluidly connected to the regenerator; and
d) a conduit fluidly connected at one end to the pulse tube and fluidly connected at its opposite end to a container, said container providing a storage volume for gas,
e) wherein the inlet is connected to the regenerator by a gas flow distribution device which distributes gas substantially evenly across and/or around the cross-sectional area of the regenerator.

According to a third aspect of the present invention, we provide a gas flow distribution device for use in a pulse tube refrigerator/cryocooler apparatus, including:

a) an inlet;
b) a plurality of outlets; and
c) a plurality of gas flow paths connecting the inlet to each of the outlets, wherein the length of the gas flow paths from the inlet to each respective outlet are substantially identical to each other.

Further features of the various aspects of the invention are set out in the claims attached hereto.

BRIEF DESCRIPTION OF THE DRAWINGS

Embodiments of the invention will now be described by way of example only with reference to the accompanying drawings, of which.

DETAILED DESCRIPTION OF THE INVENTION

Figure 1:
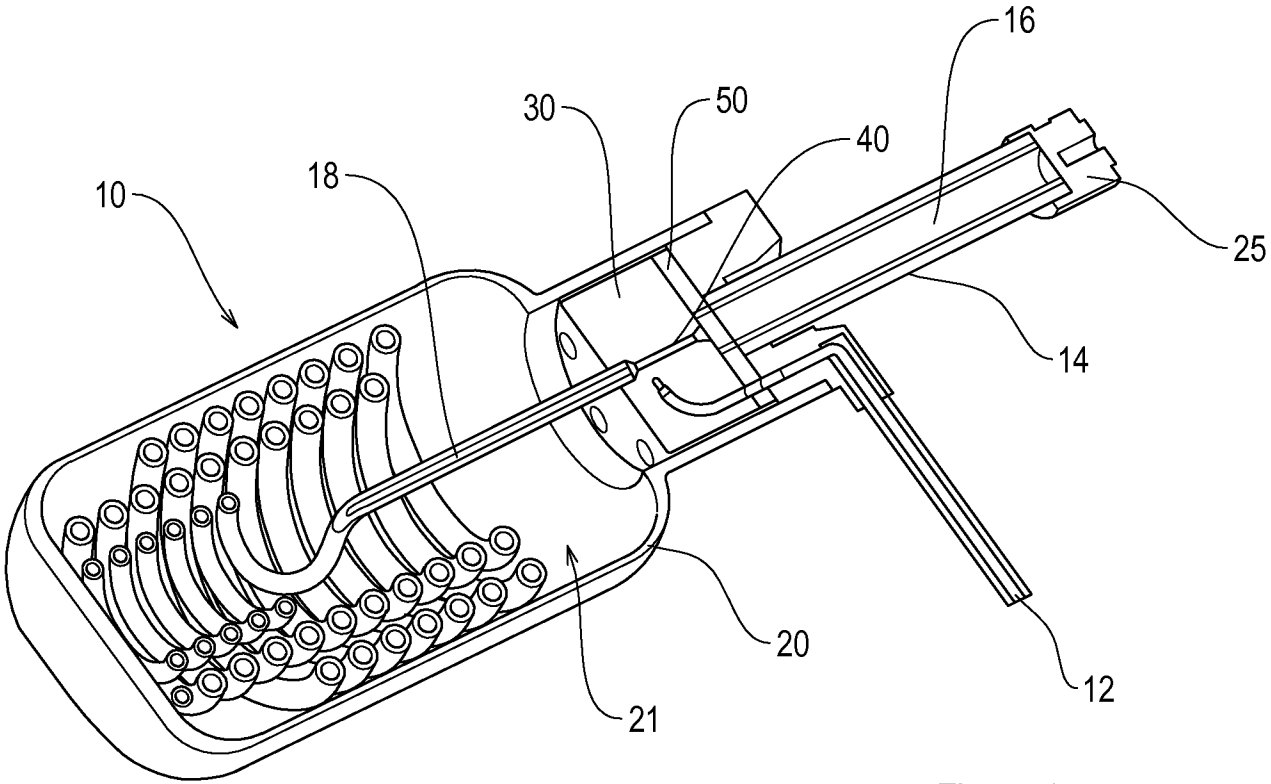
FIG. 1 is a perspective cross-sectional view through an apparatus in accordance with the present invention.
Figure 2:
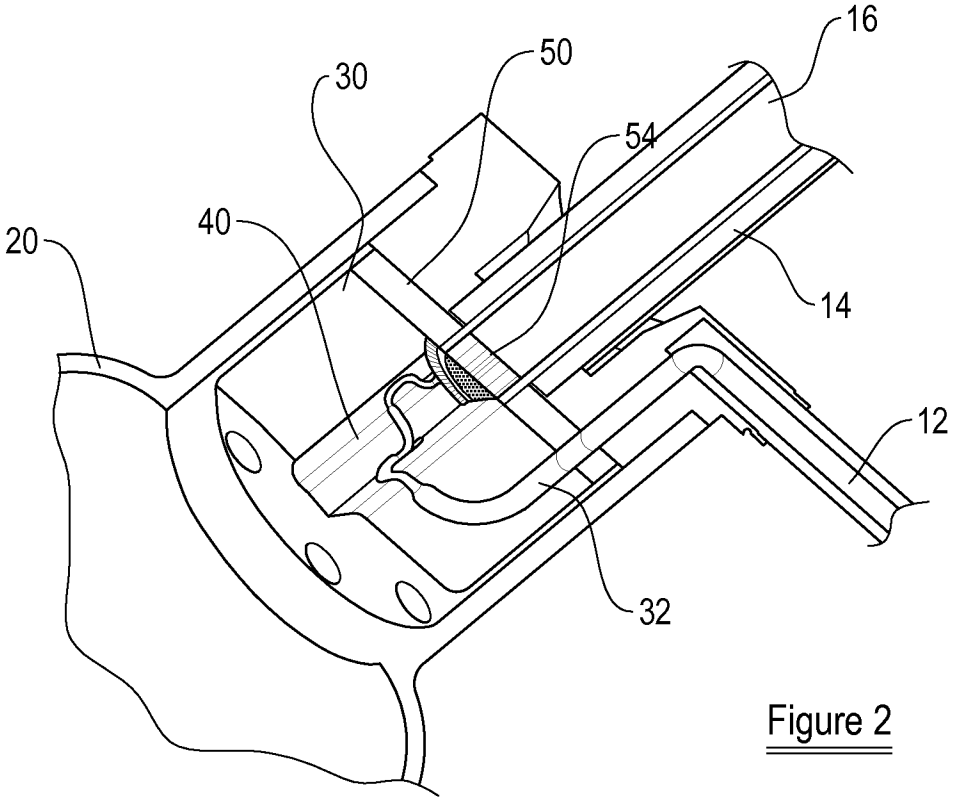
FIG. 2 is a close up cross-sectional view of a region of apparatus of FIG. 1.

Referring to FIG. 1 this shows a pulse tube refrigerator/cryocooler apparatus 10 in accordance with the present invention. The apparatus 10 includes an inlet 12 for receiving a cyclically moving volume of gas, e.g. Helium. The inlet 12 is therefore connected, in use, to a device (not shown) which can provide such a cyclically moving volume of gas. This aspect of the apparatus will not be discussed in any further detail as there are many devices in the prior art which can provide such functionality.

The apparatus 10 also includes a regenerator device 14, a pulse tube 16 and a conduit (or inertance tube as it is often known in the art) 18. The regenerator device 14 in this example has a central opening which receives the pulse tube 16. Thus the two are co-axial with each other, with the pulse tube being fluidly connected to the regenerator 14 at their ends remote from the inertance tube 18. This end also supports a "cold end" part 25. The part 25 is the part of the apparatus 10 which is to be lowered to a temperature in the order of 80K during use, and is thus connectable to any further apparatus to be so cooled.

The inertance tube 18 is fluidly connected at one end to the pulse tube by the intermediary of an opening 40 in a gas flow distribution device 30 (discussed in more detail later) and at its opposite end to the internal volume of a container 20. The container 20 (which is often referred to in the art as a "reservoir") provides a storage volume for the Helium gas and in hand with the inertance tube 18 provides the necessary phase shift between the mass flow rate and pressure of the cyclically moving gas in order to give rise to the cooling effect at the part 25, which effect is well known in the art.

Advantageously, the present invention is configured such that the cyclically moving gas enters/exits the regenerator 14 in a direction parallel to its elongate axis. In other words, the gas entering the inlet 12 passes through the gas flow distribution device 30 (discussed later) and into the regenerator 14, substantially evenly across its annular cross-section such that the gas moves in the axial direction of the regenerator 14. Such a configured flow of the cyclically moving gas ensures that minimal mixing of gas occurs which leads to improved efficiency of the apparatus 10.

As mentioned above, the apparatus 10 includes a gas flow distribution device 30 which distributes gas substantially evenly across and/or around the cross-sectional area of the regenerator 14. The gas flow distribution device (which can be seen better in FIGS. 2 through 9) includes an inlet 32 which is fluidly connected to the inlet 12 and a plurality of outlets 34 (*a* through *q*) which are connected to the inlet 32 by respective gas flow paths.

The gas flow distribution device 30 is preferably manufactured by a rapid prototyping technique, e.g. selective metal laser sintering, which enables complex gas flow paths to be provided between the inlet 32 and each of the respective outlets 34 *a* to *q*. Other rapid prototyping techniques could be used.

Figure 8:
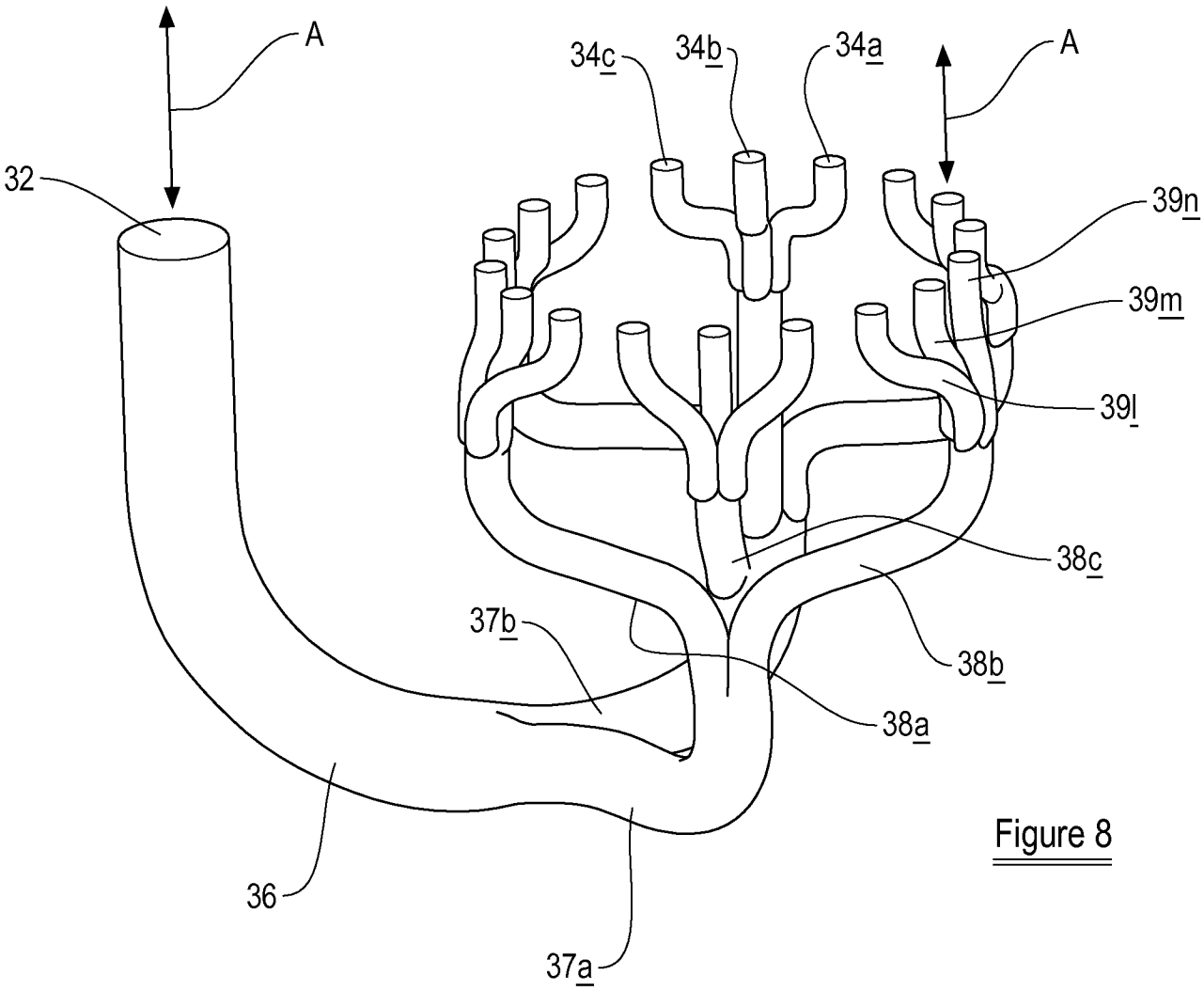
FIG. 8 is a perspective view of the gas flow path within the gas distribution device of FIG. 5.

FIG. 8 illustrates the gas flow paths constructed within the gas flow distribution device 30 from which it can be seen that each gas flow path (i.e. the path between the inlet 32 and each respective outlet 34*a-q*) includes a first gas flow path portion 36 which divides into two second gas flow path portions 37*a*, 37*b*. Each gas flow path portion 37*a, b* divides into three respective third gas flow path/portions: 38*a, b* and *c* from gas flow path portion 37*a* and 38*d, e* and *f* from the gas flow path portion 37*b*. Finally each of the gas flow path portion 38 divides into three fourth gas flow path portions 39 (with respective letter numbering) each of which leads to a respective gas flow path outlet 34 (with respective letter numbering).

The length of each of the gas flow paths between the inlet 32 and the respective outlet 34 are substantially identical to each other, which means that the gas flow distribution device 30 is configured such that the flow rate of gas exiting/entering one outlet 34 is substantially identical to all of the other outlets 34 during use. This substantially even distribution of the gas flow through the device 30 ensures substantially even distribution of the gas across the annular cross-sectional area of the regenerator 14. In hand with that, the smooth transition between each adjacent gas flow path portion, and the configured cross-sectional area thereof, ensures minimal pressure drop between the inlet 32 and each respective outlet 34. Thus, the pressure of the cyclically moving gas at each of the outlets 34 is substantially the same. Thus, the resistance to flow along the gas flow paths are substantially identical to each other.

As shown in the figures, the gas flow distribution device 30 includes a generally axially extending opening 40 which fluidly connects the pulse tube 16 to the inertance tube 18. The outlets 34 of the gas flow paths are positioned around the generally axially extending opening 40. In the present example there are 18 outlets 34, and thus they are each positioned at an angle of 20 degrees around the axis of the opening 40.

As can be seen from the figures, the end portion of each of the fourth gas flow path portions 39 is aligned substantially parallel with the axis of the regenerator, which means that the flow of the gas into the regenerator 14 is linearized with the axis of the regenerator 14.

In order to assist with this linearization of the gas into the regenerator 14, the apparatus 10 is also provided with a gas flow linearization device 50 which is positioned in between the gas flow distribution device 30 and the pulse tube/regenerator. The gas flow linearization device 50 fluidly connects to the outlets 34 of the gas flow distribution device 30. In more detail the gas flow linearization device 52 includes a plurality of first gas flow path channels 52 which are positioned substantially evenly around the periphery of the device 50 and which are aligned substantially parallel with each other. The first gas flow path channels 52 communicate with the outlets 34 from the device 30, at one end, and at an opposite end with the regenerator 14.

The device 50 also includes a plurality of second gas flow path channels 54 which are positioned inwardly towards the axis of the device 50. These channels 54 provide fluid communication between the opening 40 of the device 30 and the pulse tube 16.

Figure 3:
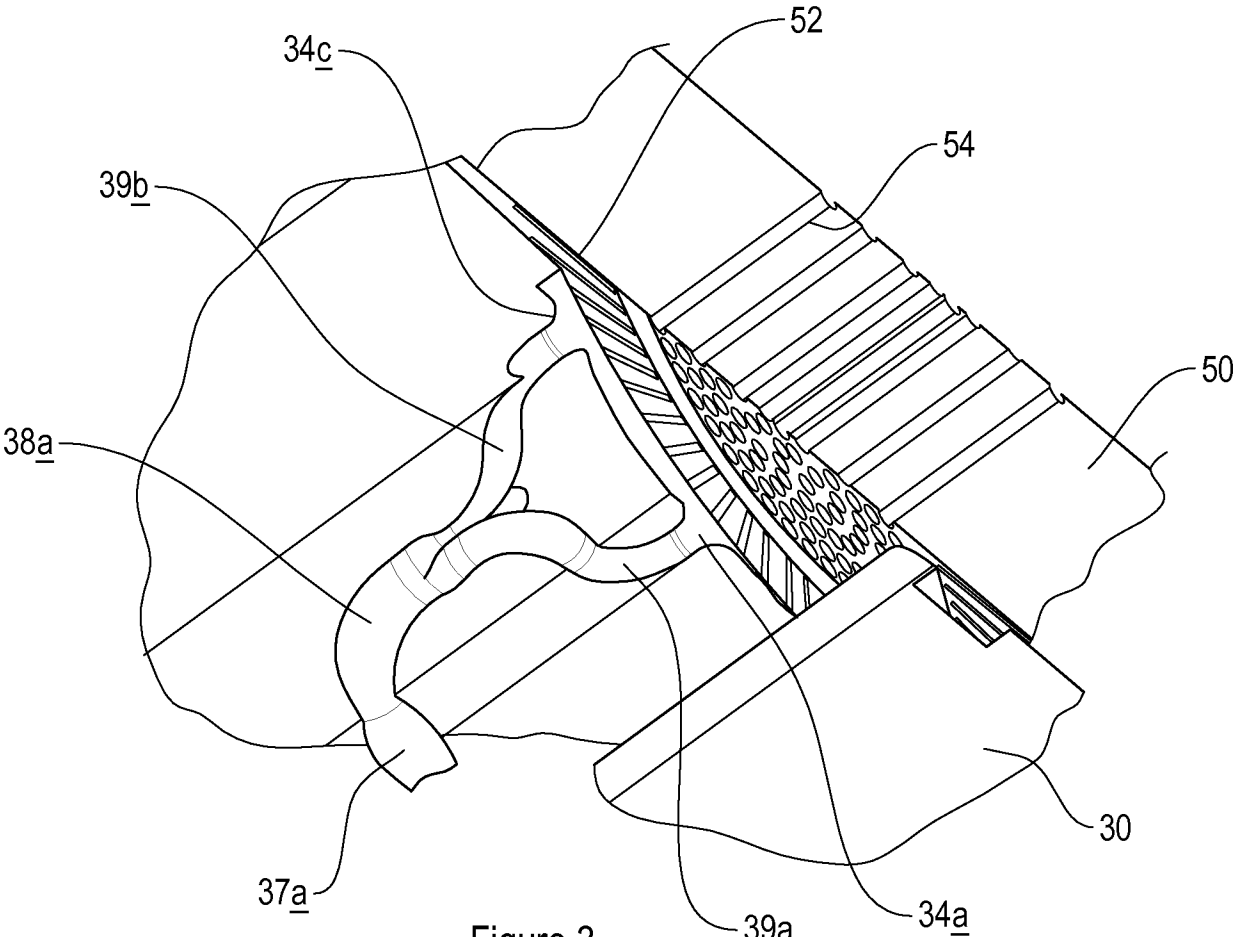
FIG. 3 is a close up cross-sectional view of a region of apparatus of FIG. 1.
Figure 4:
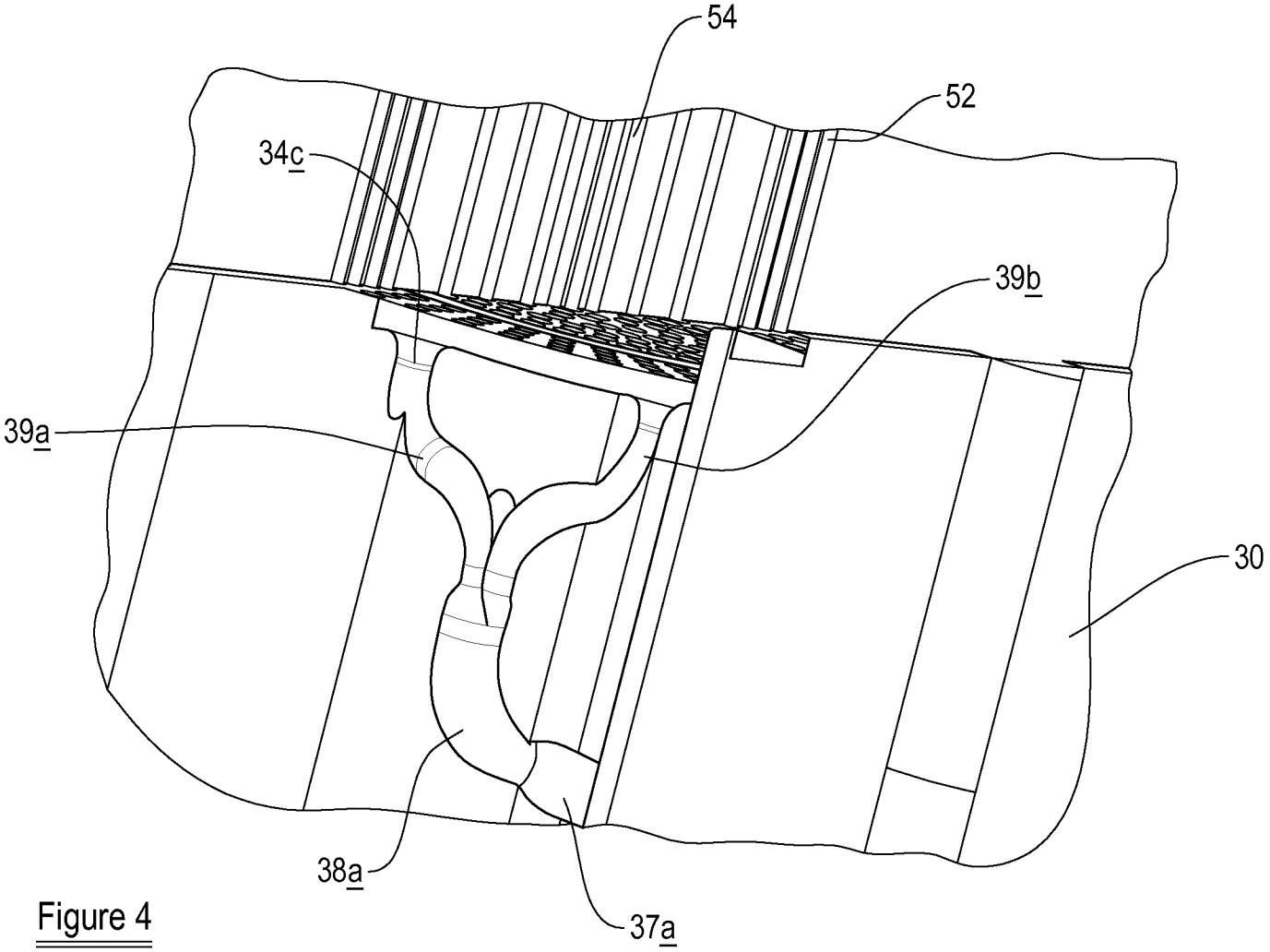
FIG. 4 is a close up cross-sectional view of a region of apparatus of FIG. 1.
Figure 5:
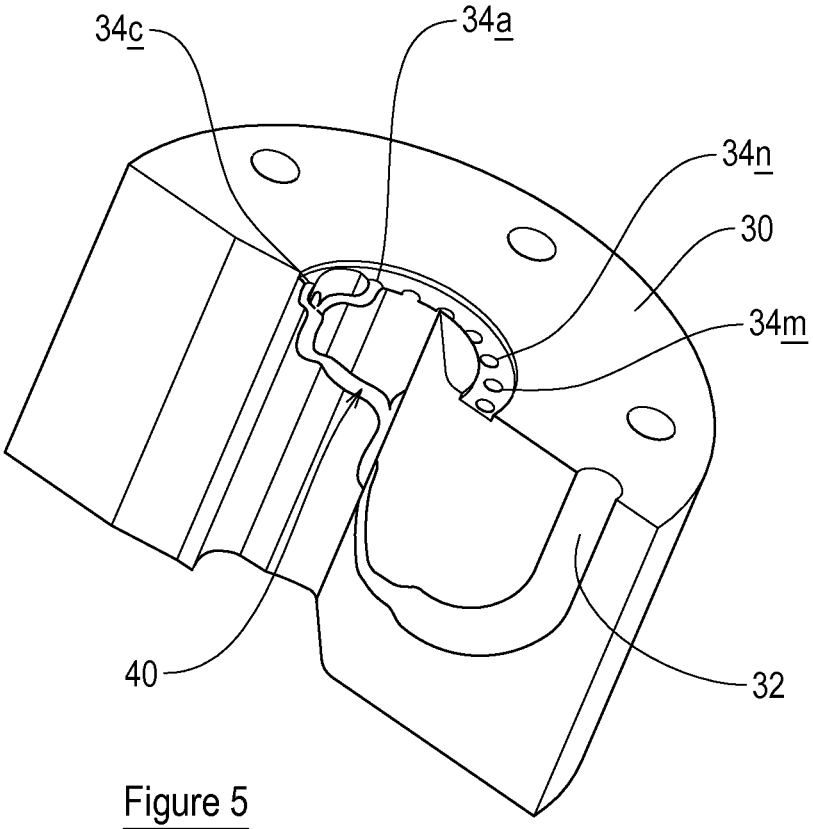
FIG. 5 is a perspective view of a gas distribution device in accordance with the present invention.
Figure 6:
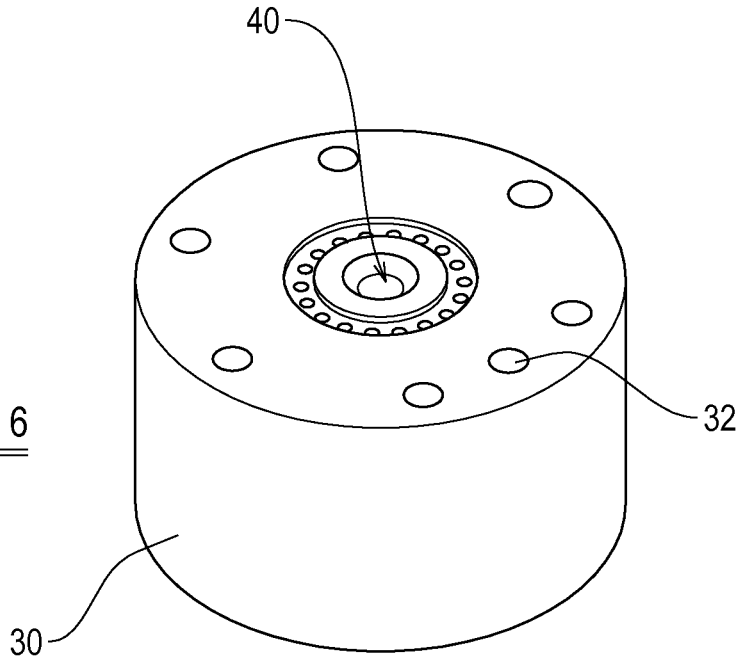
FIG. 6 is a further perspective view of the gas distribution device of FIG. 5.
Figure 7:
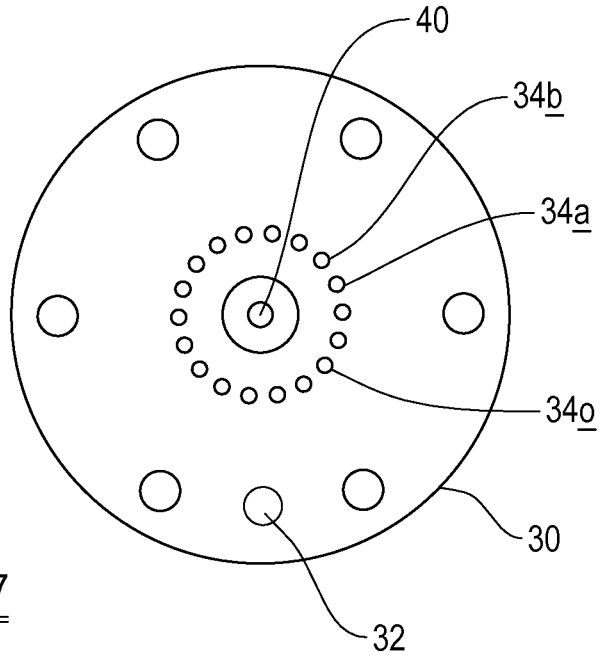
FIG. 7 is a plan view of the gas distribution device of FIG. 5.

The channels 52, 54 can take many forms, but it should be noted that in FIGS. 3 and 4 there are shown two different configurations. In FIG. 3 the channels 52 are substantially rectangular in cross-section, whilst the channels 54 are circular in cross-section. In FIG. 4 both the channels 52 and 54 are generally circular in cross-section. These elongate gas flow path channels 52, 54 further linearize the flow of gas between the pulse tube and the conduit (in the case of the channels 54) and between the outlets 34 and regenerator 14 (in the case of the channels 52).

Whilst in the present embodiment pulse tube 16 extends through an axially extending opening in the regenerator 14, it should be noted that the pulse tube and regenerator could, in alternative embodiments, be connected in end-to-end relationship, as is well known in the art of cryocoolers.

Figure 9:
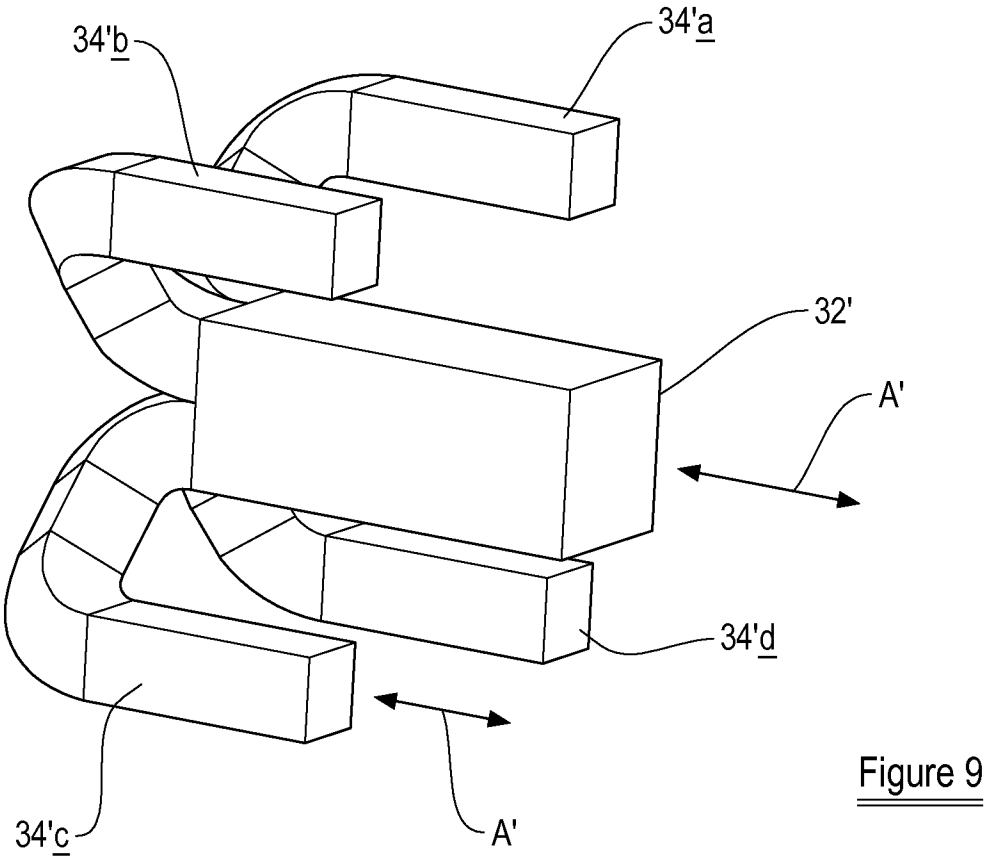
FIG. 9 is a perspective view of an alternative configuration of the gas flow paths.
Figure 10:
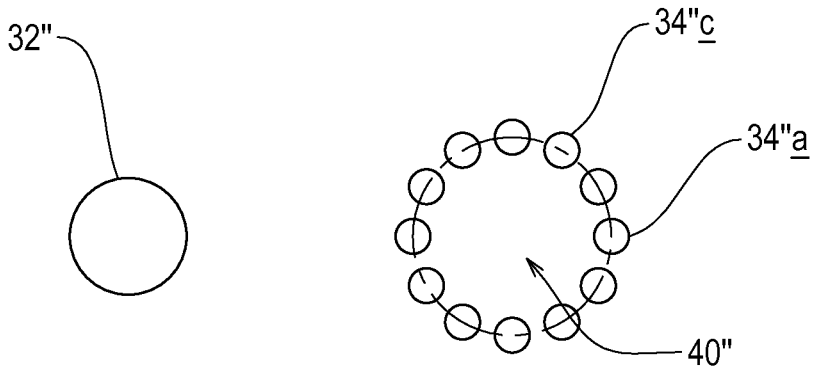
FIGS. 10 to 15 are illustrative views of alternative configurations of gas flow paths for a gas distribution device in accordance with the present invention.
Figure 11:
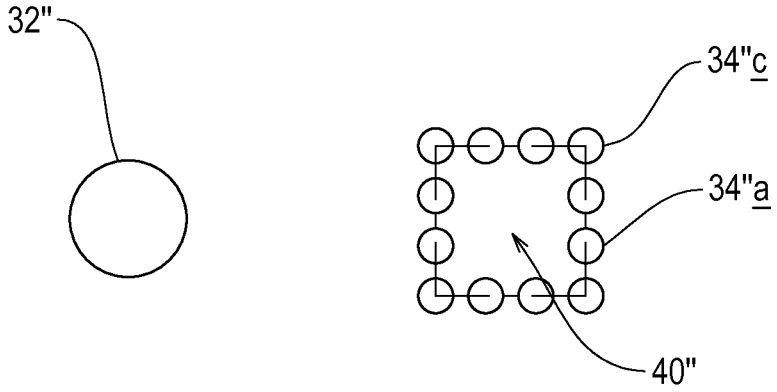
Figure 12:
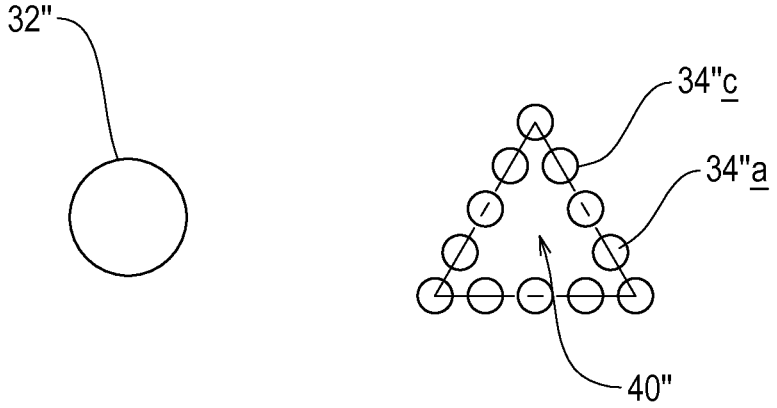
Figure 13:
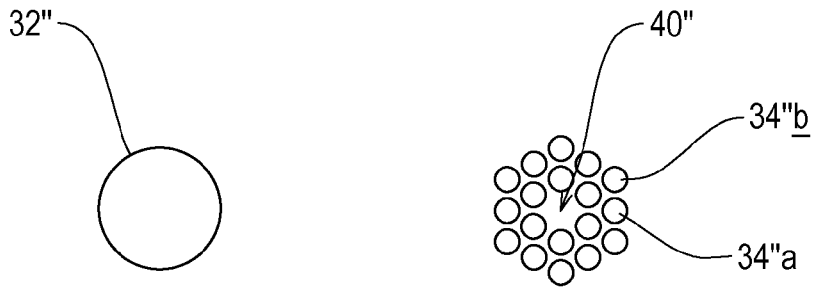

Referring to FIGS. 9 to 15, these show alternative configurations of the gas flow paths between the inlet to the device 30 and its outlets 34. In FIG. 9 the inlet 32' divides into four outlets 34'*a* to *d*. In the embodiments shown in FIGS. 10, 11, 12, 13, the inlet 32" is circular in cross-section, as are the outlets 34" *a* through *x*, and each has a opening 40" positioned within the outlets 34". The only difference is the configuration of the outlets 34". In FIG. 10 they form a generally circular array, similar to the embodiment shown in FIG. 8. In FIG. 11 they form a rectangular (square) array. In FIG. 12 they form a generally triangular array. In FIG. 13 the outlets form a generally hexagonal array with two rows of outlets around the periphery of the opening 40".

Figure 14:
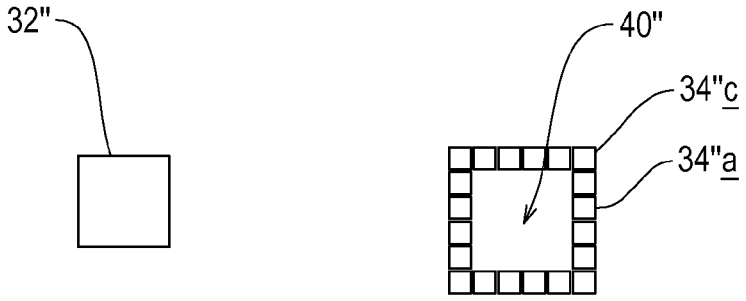
Figure 15:
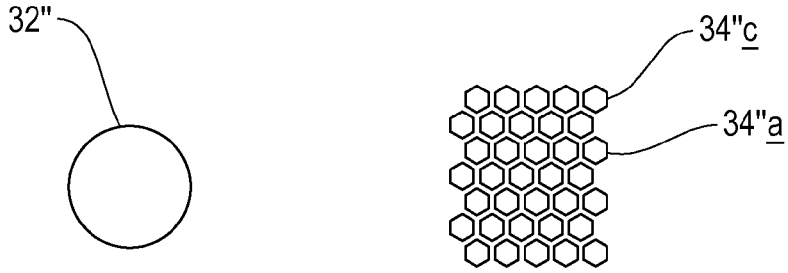

In FIG. 14 the inlet 32" is rectangular (square) in cross-section, as are the outlets 34", with the outlets 34" being provided in a rectangular (square) array. Finally, in FIG. 15 the inlet 32" is circular in cross-section, but the outlets 34" are hexagonal and are provided in a nested array (e.g. honeycomb configuration).

It should be appreciated, however, that the cross-sectional shape of the inlet(s) and outlet(s) may be any desired shape, provided that the length of and/or resistance to flow along each of the plurality of gas flow paths are substantially identical to each other.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A pulse tube refrigerator/cryocooler apparatus including:

an inlet for receiving a cyclically moving volume of gas;

a regenerator device fluidly connected to the inlet for storing and recovering thermal energy from the gas;

a pulse tube fluidly connected to the regenerator; and a conduit fluidly connected at one end to the pulse tube and fluidly connected at its opposite end to a container, said container providing a storage volume for gas, wherein the inlet is connected to the regenerator by a gas flow distribution device which distributes gas evenly across and/or around the cross-sectional area of the regenerator, wherein the gas flow distribution device includes:

an inlet of the gas flow distribution device;

a plurality of outlets; and a plurality of gas flow paths connecting the inlet of the gas flow distribution device to each of the outlets, wherein the length of the gas flow paths from the inlet of the gas flow distribution device to each respective outlet are identical to each other.

2. An apparatus according to claim 1 wherein the inlet of the gas flow distribution device is fluidly connected to the inlet of the apparatus.

3. An apparatus according to claim 2 wherein a respective gas flow path is provided between the inlet of the gas flow distribution device and each of the outlets of the gas flow distribution device.

4. An apparatus according to claim 3 wherein the gas flow paths from the inlet of the gas flow distribution device to each of the outlets of the gas flow distribution device are configured such that the flow rate of gas exiting one outlet is identical to the flow rate of gas exiting all of the other outlets.

5. An apparatus according to claim 4 wherein the length of the gas flow paths and/or the flow resistance from the inlet of the gas flow distribution device to each respective outlet are identical to each other.

6. An apparatus according to claim 5 wherein each gas flow path includes a first gas flow path portion which is connected to the inlet to the apparatus and a plurality of second gas flow path portions.

7. An apparatus according to claim 6 wherein each second gas flow path portion directs gas to a respective one of the outlets.

8. An apparatus according to claim 7 wherein each second gas flow path portion is connected to a plurality of third gas flow path portions.

9. An apparatus according to claim 8 wherein each third gas flow path portion directs gas to a respective one of the outlets.

10. An apparatus according to claim 9 wherein each third gas flow path portion is connected to a plurality of fourth gas flow path portions.

11. An apparatus according to claim 10 wherein each fourth gas flow path portion directs gas to a respective one of the outlets.

12. An apparatus according to claim 11 wherein the gas flow paths are configured such that the pressure of the cyclically moving gas at each of the outlets is the same.

13. An apparatus according to claim 12 wherein the gas flow paths are configured such that the pressure of the cyclically moving gas at each of the outlets is the same as the pressure of the cyclically moving gas at the inlet to the apparatus.

14. An apparatus according to claim 13 wherein the gas flow distribution device includes a generally axially extending opening which fluidly connects the pulse tube to the conduit.

15. An apparatus according to claim 14 wherein the gas flow paths extend around the generally axially extending opening.

16. An apparatus according to claim 1, wherein the inlet is directly connected to the inlet of the gas flow distribution device and the outlets are each directly connected to the regenerator.

17. A gas flow distribution device for use in a pulse tube refrigerator/cryocooler apparatus, the pulse tube refrigerator/cryocooler apparatus having an inlet for receiving a cyclically moving volume of gas and a regenerator device, wherein the gas flow distribution device is for connecting the inlet to the regenerator, the gas flow distribution device including:

a gas flow distribution device inlet;

a plurality of outlets; and a plurality of gas flow paths connecting the inlet to each of the outlets, wherein the length of the gas flow paths from the inlet to each respective outlet are identical to each other.

18. A gas flow distribution device according to claim 17 further including a gas linearization device fluidly connected to the outlets, and the gas linearization device is configured to linearize the flow of gas therefrom.

19. A gas flow distribution device according to claim 18 wherein the gas linearization device includes a plurality of first gas flow channels which are aligned substantially parallel with each other and which communicate with the plurality of outlets.

20. A gas flow distribution device according to claim 17 wherein the gas flow distribution device inlet is configured to connect directly to the inlet of the apparatus, and wherein each respective outlet is configured to connect directly to the regenerator.

* * * * *